United States Patent [19]

Robinson et al.

[11] 4,186,639

[45] Feb. 5, 1980

[54] RHYTHM GENERATOR FOR ELECTRONIC ORGAN

[75] Inventors: John W. Robinson; Ralph N. Dietrich, both of Jasper, Ind.

[73] Assignee: Kimball International, Inc., Jasper, Ind.

[21] Appl. No.: 867,112

[22] Filed: Jan. 5, 1978

[51] Int. Cl.[2] ..... G10H 1/00; G10H 5/00

[52] U.S. Cl. ..... 84/1.03; 84/DIG. 12

[58] Field of Search ..... 84/1.01, 1.03, 1.24, 84/DIG. 12

[56] References Cited

U.S. PATENT DOCUMENTS

| | | | |
|---|---|---|---|
| Re. 28,999 | 10/1976 | Southard | 84/1.03 |
| Re. 29,144 | 3/1977 | Bunger | 84/1.01 |
| 3,763,305 | 10/1973 | Nakada et al. | 84/1.03 |
| 3,958,483 | 5/1976 | Borrevik et al. | 84/1.03 |
| 4,072,078 | 2/1978 | Shallenberger et al. | 84/1.03 |
| 4,089,245 | 5/1978 | Dietrich | 84/1.03 |

*Primary Examiner*—S. J. Witkowski

*Attorney, Agent, or Firm*—Albert L. Jeffers; John F. Hoffman

[57] ABSTRACT

An electronic rhythm generator particularly suited for incorporation in an electronic organ. A counter, clocked by time sequential rhythm clock pulses, produces a cyclically repeating series of counts comprising binary words having a most significant bit and a plurality of least significant bits which address a read only memory having a plurality of preprogrammed rhythm patterns stored therein. The memory comprises two sections in which a first set and a second set of rhythm patterns respectively are stored and which is programmed such that one of the sections is enabled only when the most significant bit of the counter output is a logic 1 and the other section is enabled only when the most significant bit is a logic 0. The memory responds to a series of sequential enabling signals on certain of its address lines corresponding to the respective least significant bits of the binary words to produce at its output rhythm signals in the rhythm patterns selected within its enabled section. Player actuated override control means are provided for selectively holding the most significant bit of the counter output at either of the aforementioned logic levels so as to cause one or the other of the selected rhythms to repeat for each cycle of the least significant bit portion of the binary word. If the most significant bit of the count is permitted to change states every half cycle of the total count sequence, the rhythm pattern will alternate between the two selected rhythms.

15 Claims, 3 Drawing Figures

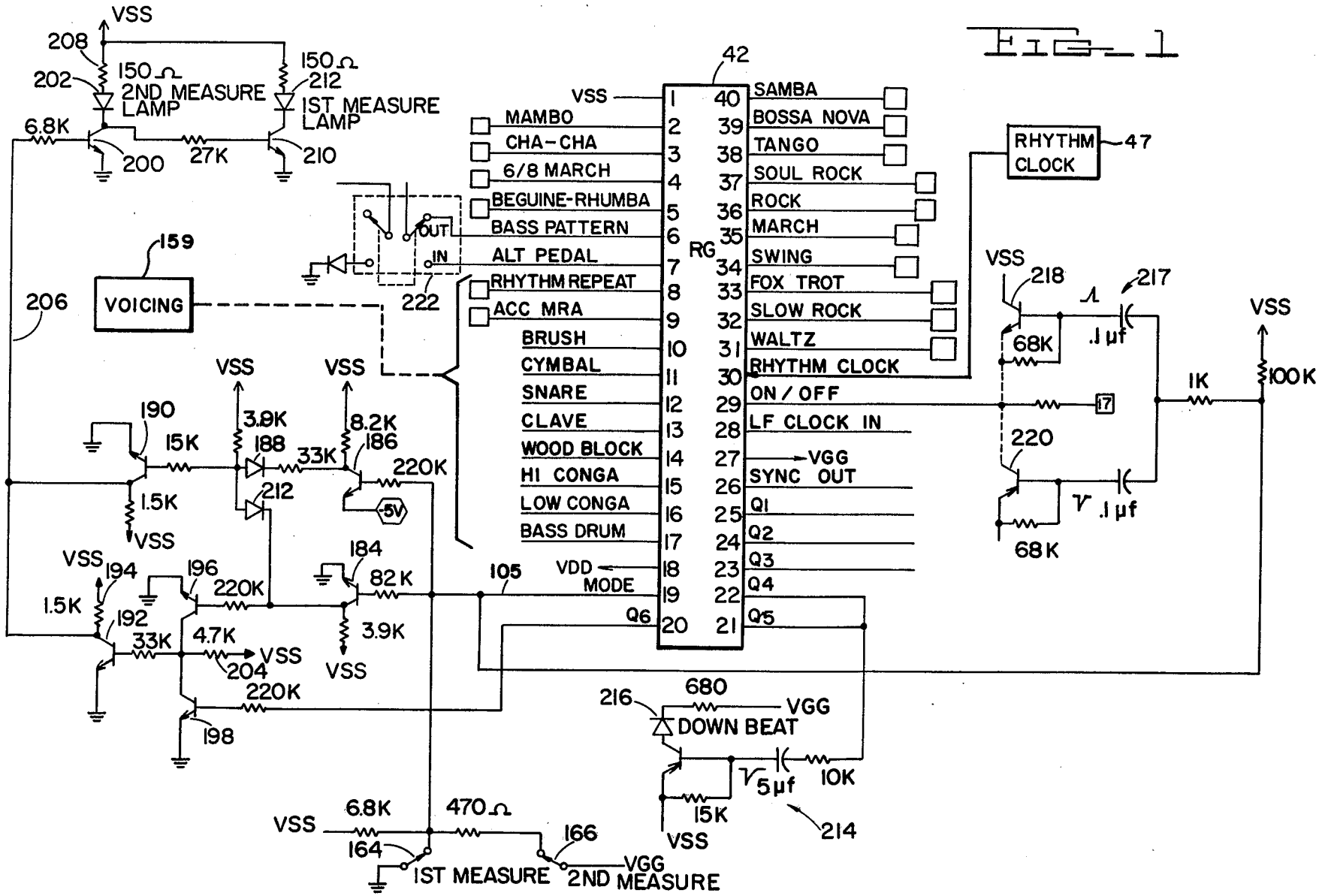
RHYTHM CLOCK
47
VSS
100K
1K
217
.1μf
218
68K
220
17
42
SAMBA
BOSSA NOVA
TANGO
SOUL ROCK
ROCK
MARCH
SWING
FOX TROT
SLOW ROCK
WALTZ
RHYTHM CLOCK
ON / OFF
LF CLOCK IN
VGG
SYNC OUT
Q1
Q2
Q3
Q4
Q5
Q6
RG
MAMBO
CHA-CHA
6/8 MARCH
BEGUINE-RHUMBA
BASS PATTERN
ALT PEDAL
RHYTHM REPEAT
ACC MRA
BRUSH
CYMBAL
SNARE
CLAVE
WOOD BLOCK
HI CONGA
LOW CONGA
BASS DRUM
VDD
MODE
DOWN BEAT
680
10K
15K
214
216
166
2ND MEASURE
1ST MEASURE
470Ω
6.8K
164
105
222
OUT
IN
220K
5V
8.2K
186
82K
3.9K
184
33K
188
212
15K
190
1.5K
196
4.7K
204
198
192
194
VOICING
159
206
150Ω
212
1ST MEASURE LAMP
210
27K
2ND MEASURE LAMP
200
208
202
6.8K

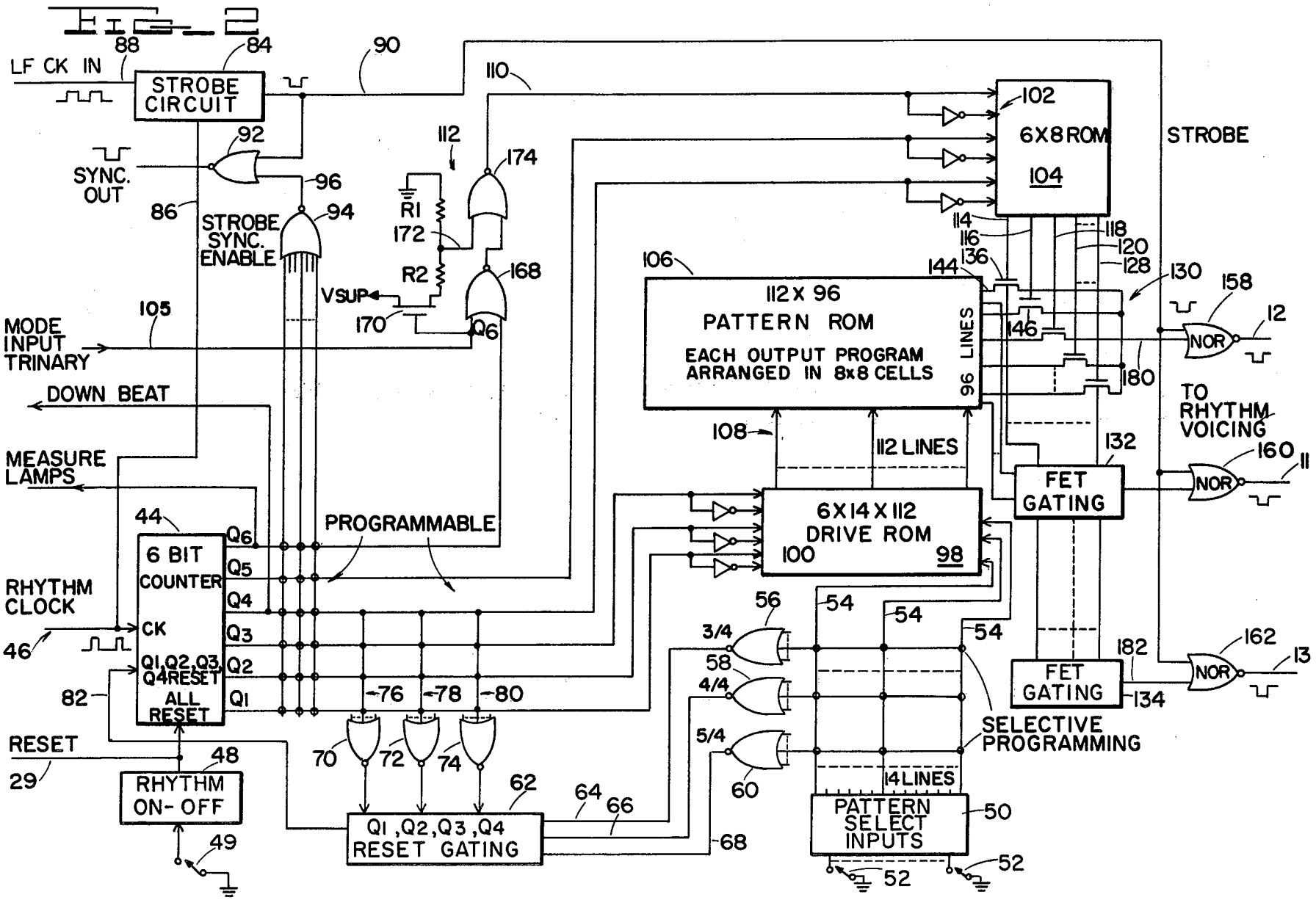
STROBE
6X8 ROM
104
102
NOR
158
12
130
TO RHYTHM VOICING
160
11
162
13
180
118
120
128
132
FET GATING
182
134
FET GATING
SELECTIVE PROGRAMMING
146
114
116
136
144
96 LINES
112 X 96 PATTERN ROM
EACH OUTPUT PROGRAM ARRANGED IN 8x8 CELLS
106
112 LINES
108
6X14 X 112 DRIVE ROM
98
100
54
50
52
14 LINES
PATTERN SELECT INPUTS
56
58
60
3/4
4/4
5/4
68
66
64
62
Q1, Q2, Q3, Q4 RESET GATING
74
72
70
80
78
76
PROGRAMMABLE
110
174
168
Q6
112
R1
172
R2
170
VSUP
90
96
94
92
STROBE SYNC. ENABLE
84
STROBE CIRCUIT
86
88
LF CK IN
SYNC. OUT
105
MODE INPUT TRINARY
DOWN BEAT
MEASURE LAMPS
Q6 Q5 Q4 Q3 Q2 Q1
6 BIT COUNTER
44
CK
Q1,Q2,Q3,Q4 RESET
ALL RESET
RHYTHM CLOCK
46
82
48
RHYTHM ON-OFF
49
RESET
29

RHYTHM GENERATOR FOR ELECTRONIC ORGAN

BACKGROUND OF THE INVENTION

The present invention relates to an automatic rhythm generator and in particular to an electronic rhythm generator adapted for incorporation into an electronic organ.

Electronic rhythm generators are well known and generally provide a relatively full complement of percussion sounds, such as brush, cymbal, clave, drum, etc., which are selectively combined in a predetermined sequence and at a rate and spacing which is determined by the particular rhythm selected by the player. For example, a given rhythm sequence may include snare drum, brush and cymbal percussion sounds which are arranged in a rhythmically pleasing fashion. Generally, the selected rhythm sequence is cycled repetitively every sixteen beat measure without the necessity for further intervention by the player.

With increasing complexity of the circuitry employed in electronic organ design, large scale integration of elements into a single chip has become extremely valuable from the standpoint both of cost and maintenance. One drawback to integration of major portions of the circuitry into a single chip is the inability to externally control what is occurring internally within the chip. Additionally, the limitation in number of external pins on the chip, which is dictated by convention, limits the number of inputs and outputs and reduces the opportunity for monitoring various points in the internal circuitry. This is disadvantageous from the standpoint that certain internal functions are particularly suitable for providing external control signals.

SUMMARY OF THE INVENTION

The rhythm generator according to the present invention includes an integrated circuit chip in which the major control functions and pattern storage are accomplished. Considerable versatility is realized by virtue of certain chip outputs which transmit the inner functioning of the rhythm chip to the external circuitry. This permits external control of the manner in which the rhythm pattern memory is addressed so that twice as many patterns are now available for a given number of rhythm select input lines.

The rhythm pattern memory is divided into first and second sections which are alternately enabled by the most significant bit of the rhythm counter output. A single rhythm select input line selects a rhythm pattern from each of the memory sections and if the most significant bit of the count is permitted to change states on each half cycle of the count sequence, one of the selected patterns will play for one measure, the other selected pattern for the next measure, the first pattern for the next measure, and so on. If the most significant bit of the count is held at either of its states by means of an external control signal, one or the other of the selected rhythm patterns will be played repetitively for each rhythm measure. In order to realize maximum economy of external chip pins, this control function is accomplished by means of a trinary input signal.

Output pins for each of the bits of the rhythm count are possible so that external monitoring of the internal sequencing control is possible. This enables an alternating light system to be provided whereby one lamp will be illuminated when the first measure pattern is being played and the other lamp when the second measure pattern is being played. By monitoring a selected one of the count bits, a visual downbeat indication can be provided.

Internally within the chip, it comprises a large pattern read only memory, pattern select circuitry, a six bit counter, strobe generator, and output gating. The output gating consists of twelve lines which represent the twelve instrument panels such as snare drum, clave, cymbal, etc. The mode control simply inhibits the most significant bit of the six bit counter and allows the code ROM to decode only the first half of the pattern ROM or, alternatively, the second half of the pattern ROM or, alternatively, the first half and second half on an alternating basis.

Specifically, the present invention contemplates an electronic rhythm generator comprising: a source of rhythm clock pulses, memory means having a first section for storing a plurality of first rhythm patterns and a second section for storing a plurality of second rhythm patterns, player controlled pattern select means for selecting first and second patterns respectively from the first and second memory sections, player actuated multistate control means for enabling only the first memory section when in its first state and enabling only the second memory section when in its second state and alternately enabling the first and second memory sections at a rhythmic rate when in its third state, the memory means including a plurality of address lines and a plurality of output lines adapted for connection to organ voicing means and being programmed to respond to a series of sequential enabling signals on its respective address lines to produce on the output lines thereof in cyclic fashion rhythm signals in the rhythm pattern selected within the enabled section of the memory, and counter means clocked by the rhythm clock pulses for producing a cyclically repeating series of counts supplied to the address lines of the memory means to enable selected address lines on respective counts.

It is an object of the present invention to provide an electronic rhythm generator wherein the control functions and memory are contained within a single integrated circuit chip having rhythm data output pins, rhythm pattern select pins and pins whereby the internal functioning of the circuitry can be monitored and controlled.

Another object of the present invention is to provide an electronic rhythm generator wherein twice as many rhythm patterns are available as there are pattern select input lines to the chip by employing a multi-section read only memory wherein the sections are selectively enabled by controlling the most significant bit of the rhythm count.

Yet another object of the present invention is to provide an electronic rhythm generator which is internally programmable to count in a variety of rhythm timing modes such as $\frac{3}{4}$, 4/4 or 5/4 time.

A further object of the present invention is to provide an electronic rhythm generator wherein the control functions and memory are contained within a single integrated circuit chip and external control is achieved by a trinary input.

These and other objects and features of the present invention will be apparent from the detailed description taken together with the accompanying drawings.

BRIEF DESCRIPTION OF THE DRAWINGS

FIG. 1 is a schematic diagram of the rhythm generator integrated circuit chip and the associated external control and indicating circuitry;

FIG. 2 is a schematic diagram of the internal circuitry of the rhythm generator chip.

DETAILED DESCRIPTION

Figure 3:
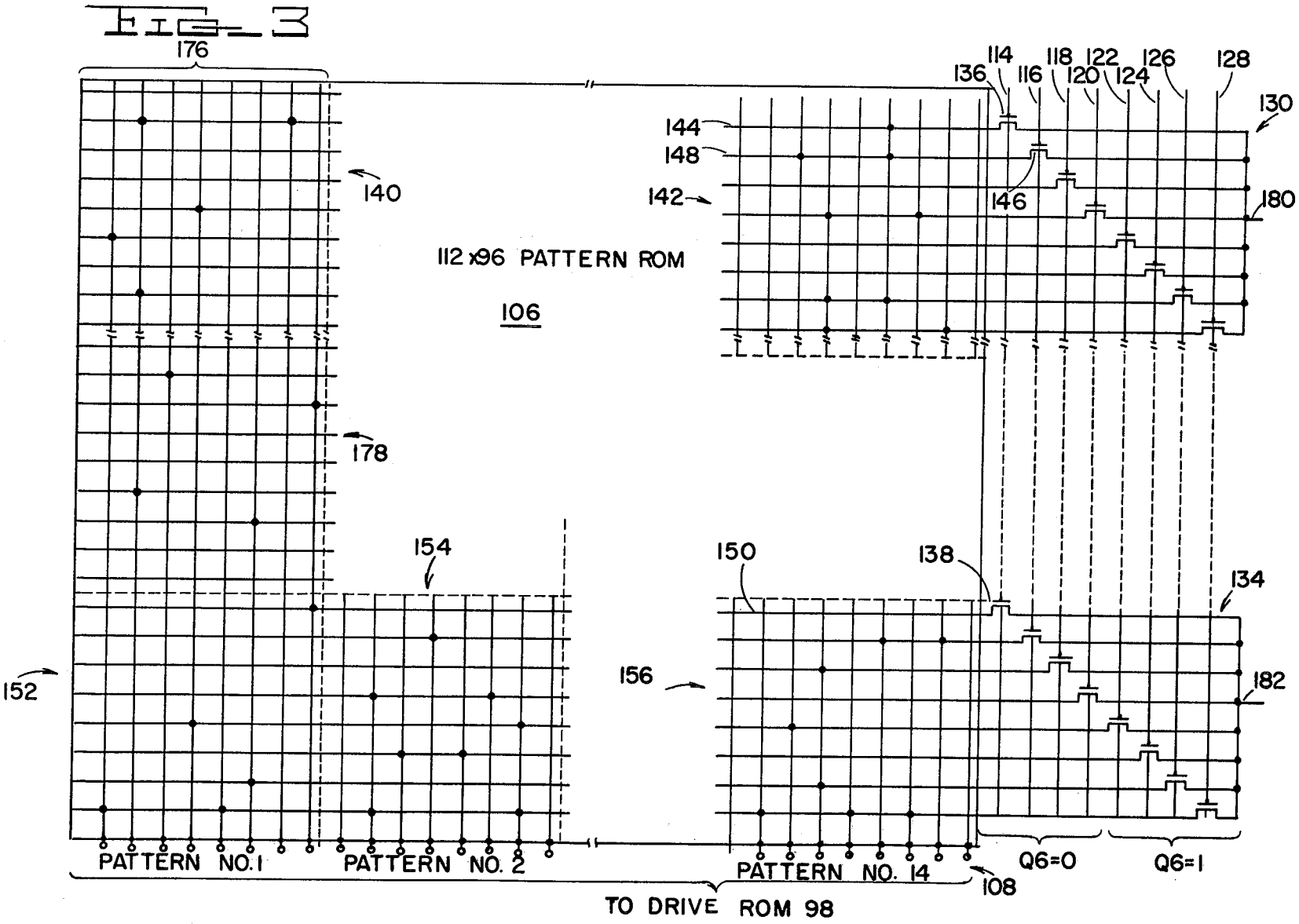
FIG. 3 is a diagrammatic representation of the general arrangement of the rhythm pattern ROM.

Referring initially to FIG. 1, the electronic rhythm generator according to the present invention includes an integrated circuit chip 42 having external pins 1 through 40 to provide control, pattern select and pattern data output. The internal circuitry of chip 42 is shown in greater detail in FIG. 2 and is seen to comprise a six bit counter 44 having a clock input 46 which receives rhythm clock pulses from an external rhythm clock 47. Rhythm counter 44 is reset by rhythm on/off circuitry 48 which is controlled by switch 49 connected to ground.

When counter 44 is enabled by rhythm on/off circuit 48, it responds to rhythm clock pulses on input line 46 and provides a six bit count on its output lines Q1, Q2, Q3, Q4, Q5 and Q6. This six bit binary word controls the timing and sequencing of the rhythm generating circuitry as will be described in detail hereinafter.

Because all rhythms are not in 4/4 time, it is necessary to modify the count sequence produced by counter 44 for $\frac{3}{4}$ and 5/4 time. For example, waltz, slow rock and 6/8 march rhythms are all in $\frac{3}{4}$ time whereas a fox trot or cha cha are in 4/4 time. The particular pattern which is desired is selected by means of pattern select input circuitry 50 which has fourteen, for example, external rhythm select switches 52 which are connected to respective ones of input pins 2 through 5 and 31 through 40 (FIG. 1). Depending on which of external switches 52 are closed, one of lines 54 will be activated. Multiple input NOR gates 56, 58 and 60 are selectively connected to lines 54 such that when respective lines 54 are activated, one of NOR gates 56, 58 and 60 will provide an input to reset gating 62 over lines 64, 66 and 68, respectively.

Multiple input NOR gates or NOR ROMS 70, 72 and 74 have their respective input lines 76, 78 and 80 connected to selected ones of the Q1 through Q4 outputs of counter 44. NOR gates 70, 72 and 74 function to decode the Q1 through Q4 outputs of counter 44 and reset gating 62 will place a reset signal on line 82 which resets the Q1, Q2, Q3 and Q4 outputs of counter 44 depending on which one of lines 62, 66 and 68 is enabled and on which one of NOR gates 70, 72 and 74 is activated. In other words, this arrangement decodes a portion of the count, determines which rhythm timing is selected and then resets the first four bits of the count at various times during the count sequence. In $\frac{3}{4}$ time, for example, counter 44 counts from 0 through 11, count 12 is decoded and gating 62 resets the first four bits of counter 44 so that it in effect skips to count 16, and so on. A similar sequence of events takes place in the case of 5/4 time except that different counts are deleted. In 4/4 time, counter 44 counts through the entire six bit count sequence.

It should be noted that only representative connections between lines 54 and NOR gates 56, 58 and 60 and between the Q1 through Q4 lines and NOR gates 70, 72 and 74 have been shown. The connections are shown diagrammatically as programming points and may or may not represent an operative connection between the respective lines depending on the logic which is desired.

The rhythm clock also drives the strobe circuit 84 over line 86 and it includes a further input 88 from an external low frequency clock. This clock is brought into chip 42 on pin 28 (FIG. 1). Whenever strobe circuit 84 detects a negative transition on rhythm clock line 86, i.e. a falling edge of the pulse, it puts out a pulse lasting for a period equal to five low frequency clock cycles. Although a duration of five periods has been chosen, strobe circuit 84 can be set up to have any period within reasonable limits. The strobe pulse is fed to NOR gate 92 as is the output from NOR gate 94. NOR gate 94 decodes the Q1 through Q6 outputs of counter 44 and provides a pulse at the first count and the thirty-third count thereof so as to provide an indication at the beginning of each new rhythm measure.

In one mode of programming wherein the Q6 line of counter 44 is not connected to the respective input line of NOR gate 94, NOR gate 94 will place a positive pulse on line 96 whenever Q1 through Q5 outputs are all at logic 0, i.e. on the first and thirty-third counts. If a sync pulse is desired only on the first count, the Q6 output of counter 44 will also be connected to the respective input line of NOR gate 94 thereby preventing a sync pulse on the thirty-third count. A sync pulse will be produced by NOR gate 92 in synchronism with the strobe burst and with the logic 1 pulse from NOR gate 94. This pulse is utilized externally, for example, to reset the bass pattern on every other measure (downbeat) so that in certain patterns, such as boogie, the bass can walk up the scale on the first measure and down on the second measure.

The Q1, Q2 and Q3 outputs of counter 44, which are the least significant bit outputs, are fed to the inputs 100 of drive ROM 98. The Q4, Q5 and Q6 outputs of counter 44, which are the most significant bit outputs in relation to the Q1, Q2 and Q3 outputs, are fed to the inputs 102 of ROM 104. It will be noted that the Q6 output, which is the most significant bit output relative to the Q1 through Q5 outputs, is not directly connected to its respective input line 102 in ROM 104, but is gated with the mode input on line 105. This gating arrangement will be described in greater detail at a later point.

By way of explanation, the Q1 through Q6 outputs of counter 44 are discussed throughout the detailed description and defined in the claims in terms of most significant bits and least significant bits. Insofar as addressing ROMS 98 and 104 and pattern ROM 106 is concerned, the least significant bit outputs are Q1, Q2 and Q3 and the most significant bit outputs are Q4, Q5 and Q6. As applied to which output lines of pattern ROM 106 are enabled to play either the first rhythm pattern or second rhythm pattern, on the other hand, the Q6 output along will be identified as the most significant bit output and the Q1 through Q5 outputs as the least significant bit outputs. This distinction in terminology has particular importance in the claims.

Drive ROM 98 is sequentially addressed by means of the three bit binary word on counter 44 outputs Q1, Q2 and Q3 and is selectively enabled by the fourteen pattern select lines 54 to select one group of eight lines out of fourteen groups of eight lines connected respectively to 112 input lines in pattern ROM 106. These 112 lines are identified generally as lines 108 in FIG. 2. As shown in FIG. 3, the lines are grouped in eight line inputs for each of the patterns 1 through 14. Drive ROM 98 sequentially enables eight of the address lines 108 of the selected pattern in response to the least significant bit count on lines Q1, Q2 and Q3.

The Q4 and Q5 outputs of counter 44 and line 110 from gating 112 form the three bit addressing input to ROM 104. Assuming that line 110 follows the logic level of the Q6 output, ROM 104 is addressed to sequentially enable the eight output lines 114, 116, 118, 120, 122, 124, 126 and 128. Each of these lines 114 through 128 is connected to the gates of its respective FETS forming the 12 FET gating circuits such as 130, 132 and 134. For example, line 114 is connected to the gate of FET 136 and FET 138 (FIG. 3) as well as the gates of the ten similarly positioned FETS (not shown) therebetween. As each of the gates is enabled, the FET enables the corresponding horizontal line of the fourteen 8×8 pattern cells corresponding to that particular voicing output. In FIG. 3, for example, assume that cells 140, 142 and the 12 cells (not shown) therebetween constitute the 14 dual pattern cells for the snare drum output on pin 12. When line 114 is enabled by ROM 104, FET 136 will enable line 144. Similarly, when line 116 is enabled, FET 146 will provide a low resistance path for line 148, and so on. Since the gate of FET 138 is also connected to line 114, when the latter is enabled, FET 138 will provide a low resistance path for line 150 thereby enabling the same for each of the pattern cells 152, 154 and 156 and the 11 cells (not shown) between cells 154 and 156.

ROM 106 comprises 168 such pattern cells and collectively comprising 96 horizontal lines and 112 vertical lines. It should be borne in mind that the pattern ROM 106 diagrammatically shown in FIG. 3 is merely exemplary and other ROM configurations will be obvious to one skilled in the art. In FIG. 2, the outputs of FET gating circuit 130 are combined and strobed with the strobe pulses on line 90 in NOR gate 158 to produce a pulse which is then fed to the organ voicing circuits 159 (FIG. 1). The outputs of FET gating circuits 132 and 134 are similarly strobed in NOR gates 160 and 162 respectively and fed to other voicing circuits such as the cymbal voicing and clave voicing, for example. The nine FET gating circuits between circuits 132 and 134 which are not shown in the drawings are similarly strobed.

Because of the large size and numerous connections to pattern ROM 106, only a selected number of pattern cells and their inputs and outputs have been shown in FIG. 3. Generally speaking, however, there are 12 horizontal rows of pattern cells such as 140 and 142 having corresponding FET gating circuits identical to circuit 130. Furthermore, there are 14 columns of pattern cells such as cells 152 and 140, each cell containing two patterns, and each vertical row having eight input lines. The exact nature in which ROM 106 is addressed will be described in detail following the description of the mode input gating.

In order to control which section of each of the pattern cells such as 140, 152, etc. is selected within the constraint of a single chip input pin, trinary logic is utilized. The input signal on line 105, then, is a positive voltage for the first mode, ground for the second mode and a negative voltage for the third mode. If a positive voltage is placed on line 105 by means of switches 164 and 166 being open (FIG. 1), NOR gate 168 is enabled and FET 170 is disabled so that the signal on counter 44 output line Q6 is able to pass through. Since FET 170 is turned off, a low level is present on line 172 and NOR gate 174 will also be enabled thereby permitting the signal from the Q6 output to pass into ROM 104 over line 110. This causes ROM 104 to address each of lines 114 through 128 sequentially and effectively addresses each of the 64 address points in all 12 of the pattern cells in the column which is selected by drive ROM 98.

In the second mode, a ground is placed on line 105 and FET 170 is still not enabled because the threshold has not been passed, but the threshold of NOR gate 168 has been passed so that it is disabled and the Q6 signal is not able to pass therethrough. NOR gate 174 therefore has logic 0's on each of its inputs and places a high on its output line 110 which locks the most significant bit input to ROM 104 at a logic 1 level. This causes ROM 104 to enable only those lines 114 through 128 which correspond to binary inputs 5 through 8 on address lines 110, Q5 and Q4 so that only lines 122, 124, 126 and 128, for example, will be enabled. This causes pattern ROM 106 to play the second rhythm measure twice for each complete cycle of counter 44.

In the third mode, a negative voltage is placed on line 105 which turns on FET 170 thereby disabling NOR gate 174 and locking the output thereof to a logic 0. Gate 168 remains disabled. With line 110 locked to a logic 0, ROM 104 is addressed only by those counts on lines 110, Q5 and Q4 corresponding to counts 1 through 4 so that lines 114, 116, 118 and 120 are sequentially enabled twice during each complete count cycle of counter 44. Only the first rhythm measure of the selected dual pattern cells will be played.

Assume for example that pattern No. 1 is selected by closing the appropriate one of switches 52 and further that the selected pattern is in 4/4 time. NOR gate 58 will be enabled and reset gating 62 will permit counter 44 to sequence through the entire count cycle from count 1 through count 64.

Drive ROM 98 is enabled such that the three lease significant bit outputs Q1, Q2 and Q3 from counter 44 will selectively enable the eight lines in vertical column 176. As the vertical lines 108 are sequentially enabled, each horizontal line having an enabling connection to the vertical line 108 will be enabled up to its respective FET in FET gating circuits 130 through 134.

In the first mode wherein a positive voltage is present on line 105 to the open state of switches 164 and 166, the Q6 bit will be permitted to pass through mode gating 112 into ROM 104. This causes ROM 104 to sequentially enable lines 114 through 128 as it is addressed by the most significant bit outputs of the count from counter 44 on lines 110, Q5 and Q4. Referring to FIG. 3, this results in the highest horizontal lines of pattern cells 140, 152 and 178 as well as the cells (not shown) between cells 140 and 178 feeding FET's 136, 138, etc. to be enabled and held for a period of eight counts as the least significant bit outputs Q1, Q2 and Q3 cause the vertical lines 108 in pattern column No. 1 to be sequentially enabled. At the end of eight counts, line 114 will be disabled and line 116 will be enabled thereby causing the next lower horizontal line in each of the cells 140 through 152 to be enabled and held for counts 9 through 16. When a horizontal line and a vertical line corresponding to a connected or "filled" address location are enabled, an output pulse will appear on the appropriate one of 12 lines 180 through 182 and will be strobed in the appropriate NOR gate 158 through 162.

On the thirty-third count, the Q6 output of counter 44 will become a logic 1 and the address points in the lower half of each of the cells 140 through 152 will be sequentially addressed. Each of the cells is programmed such that it contains two rhythm patterns each lasting for a complete measure from counts 1 through 32 and 33 through 64, respectively. The effect is that of an alternating rhythm which changes with each measure.

If switch 164 is closed, a ground will be placed on line 105 thereby causing line 110 to be locked at logic level 0. For the first 32 counts of counter 44, the upper halves of cells 140 through 152 will be addressed in the same manner as previously described. On count 33, however, the Q6 output is blocked by NOR gate 168 and line 110 is clamped to a logic level 0 so that counts 1 through 32 of counter 44 repeat thereby again sequentially addressing the upper halves of cells 140 through 152.

If switch 166 is closed and switch 164 open, a negative voltage will be placed on line 105 and line 110 will be locked to a logic level 1. This causes the effective count sequence of counter 44 to begin with count 32 and count up to 64 so as to selectively address the storage locations in the lower halves only of cells 140 through 152. This sequence repeats itself for each rhythm measure as long as a negative voltage is present on line 105.

The 12 outputs of NOR gates 158 through 162 are connected to respective voicing circuits so that any combination of instrument sounds may be played for a given pattern. Rather than connecting NOR gates 158 through 162 to the strobe circuit 84, they may be utilized as accent channels wherein the pulses to be accented are controlled by the programming in pattern ROM 106, with a duration equal to one complete rhythm clock cycle for each bit programmed.

Turning again to FIG. 1, the circuitry for actuating the measure lamps and the downbeat lamp will be described. Transistor 184 is turned on when a positive voltage is present on line 105 as is transistor 186. With transistor 186 turned on, a low level is present on the collector thereby turning diode 188 on and pulling down the base of transistor 190. This then turns off transistor 190 so that the collector of transistor 192 is pulled up through resistor 194.

With the collector of transistor 184 at ground potential, transistor 196 will be turned off and its collector is essentially floating. Transistor 198 which has its base connected to the Q6 pin 20 of chip 42 will be turned on when the Q6 output is at a positive voltage, or logic level 1. This connects the collector of transistor 198 to ground and turns off transistor 192. Since the collector of transistor 190 is at positive voltage due to the VSS biasing, a positive voltage is present on line 206 and transistor 200 will be turned on thereby activating LED 202. This corresponds to the second measure of the selected dual pattern which is played when the most significant bit output Q6 is at a logic level 1.

When the Q6 output is at a logic level 0, transistor 198 will be turned off allowing the collectors on transistors 196 and 198 to float. When they are floating, VSS through resistor 204 turns on transistor 192 thereby placing ground potential on its collector and also on line 206 thereby turning transistor 200 off. With transistor 200 off, current flows from VSS through resistor 208, lamp 202 to the base of transistor 210. This current is too small to illuminate lamp 202, however, but is sufficient to turn transistor 210 on thereby illuminating the first measure lamp 212. By this arrangement, with the Q6 counter bit output alternating between logic 1 and 0, lamps 202 and 212 will be alternately illuminated.

With mode switch 164 open and mode switch 166 closed, in negative voltage VGG at approximately minus 17 volts is present in line 105. Transistor 184 remains turned off thereby back biasing diode 212 and turning on transistor 196. This places ground potential on the base of transistor 192 turning it off and permitting its collector to float. Since transistor 196 is now turned on, transistor 198 has no effect on the circuitry.

With a negative voltage on the base of transistor 186, it is turned off thereby placing a positive voltage VSS at the cathode of diode 188. Because of the VSS potential at the cathodes of diodes 188 and 212, a positive voltage is placed on the base of transistor 190 and it begins to conduct thereby placing a ground potential at its collector. This places a ground potential on line 206 thereby cutting off transistor 200 and permitting lamp 212 to be illuminated.

If switch 164 is closed, ground potential will be present on line 105 and transistor 186 will be turned on which grounds the cathode of diode 188. This turns off transistor 190 so that its collector is at VSS potential. With the input to transistor 184 at ground potential, it is turned off which places its collector at VSS potential turning on transistor 196 which places a ground at the base of transistor 192 thereby turning it off. With transistors 190 and 192 turned off, positive voltage is present on line 206 which turns on transistor 200 and illuminates lamp 202.

In addition or alternatively to utilizing the voltage level on line 206 to illuminate one of a pair of lamps, it could be utilized to drive any external circuit which is controlled by the particular rhythm measure which is being played. One example is a rhythm break generator which can be programmed with dual measure capability.

Downbeat indicator 214 includes an LED 216 which is illuminated each time the Q4 output of counter 44 goes low. This occurs every 16 counts and provides a visual indication of the downbeat. Reset circuitry 217 comprises transistors 218 and 220 which are responsive to positive going and negative going pulses, respectively, to provide a reset signal on pin 29 which resets the counter 44 each time the mode is changed. For example, if switch 166 is closed, a negative voltage on line 105 will cause a negative going spike to be developed at the base of transistor 220. Switching to VSS biasing on line 105, causes a positive going spike at the base of transistor 218.

Pin 9 on chip 42 provides rhythm pulses suitable for pulsing accompaniment voices in a musical rhythm accompaniment system and pin 8 provides a rhythm to pulse percussive voices on the solo manual. Switch 222 enables special rhythm patterns from pins 6 and 7 to be brought out for use in base pattern generation and root and fifth alternating pedal generation, respectively.

As can be seen, the above-described system posseses substantial flexibility because of the ability to monitor the internal functioning of the chip circuitry. This enables a wide variety of external devices to be controlled by the rhythm generator and provides the capability for a relatively large number of rhythm patterns with minimum pin usage.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in art to which this invention pertains and fall within the limits of the appended claims.

What is claimed is:

1. A method for generating rhythm pulses in an electronic musical comprising:

storing a first plurality of rhythm patterns and a second plurality of rhythm patterns in a memory, producing a series of cyclically repeating binary word counts which are rhythmically spaced and which each includes a most significant bit and a plurality of least significant bits, selecting a pattern from each of the first and second plurality of patterns, and addressing the memory by means of the least significant bits of the series of counts to call forth one of the selected patterns to produce a series of rhythm pulses when the most significant bit of count is at a logic 1 and to call forth the other of the selected patterns to produce an alternative series of rhythm pulses when the most significant bit of the count is at a logic 0.

2. The method of claim 1 including continuously holding the logic level of the most significant bit selectively at either a logic 1 or a logic 0.

3. The method of claim 1 including deleting selected ones of the counts to thereby reduce the number of counts in the count cycle by a factor other than a whole number.

4. An electronic rhythm generator comprising:

a source of rhythm clock pulses, counter means clocked by said clock pulses for producing at its outputs a cyclically repeating series of counts comprising binary words each having a most significant bit and least significant bits, memory means having a first section for storing a plurality of first rhythm patterns, a second section for storing a plurality of second rhythm patterns, address lines connected between said counter means and said memory means and being selectively enabled by the binary words produced by said counter means, and an output, said memory means being programmed such that one of said memory sections is enabled only when the most significant bit is a logic 1 and the other memory section is enabled only when the most significant bit is a logic 0, said memory means being further programmed to respond to a series of sequential enabling signals on certain of its address lines corresponding to the respective least significant bits of said binary words to produce at the output thereof rhythm signals in the rhythm pattern selected within its enabled section, and player actuated override control means for selectively holding said most significant bit at either a logic 1 or a logic 0 to cause the respective section to be continuously enabled.

5. The rhythm generator of claim 4 including means for decoding at least a portion of each of the binary words produced by said counter and partially resetting said counter at selected points during its count cycle.

6. The rhythm generator of claim 4 wherein said memory means, said counter means and said counter means are contained within a single integrated circuit chip and said control means includes a trinary decoder having a single external chip pin.

7. The rhythm generator of claim 6 including a plurality of external pins on said chip connected to outputs of said counter means corresponding to respective bits of said binary words.

8. The rhythm generator of claim 7 wherein one of said last mentioned pins is connected to the most significant bit output of said counter means, and including lamp means connected to said one pin for indicating the logic level thereon.

9. An electronic rhythm generator comprising:

a source of rhythm clock pulses, memory means having a first section for storing a plurality of first rhythm patterns and a second section for storing a plurality of second rhythm patterns, player controlled pattern select means for selecting first and second patterns respectively from said first and second memory sections, player actuated multistate control means for enabling only said first memory sections when in its first state and enabling only said second memory section when in its second state and enabling said first and second memory sections alternately at a rhythmically related rate when in its third state, said memory means having a plurality of address lines and a plurality of output lines adapted for connection to organ voicing means and being programmed to respond to a series of sequential enabling signals on its respective address lines to produce on the output lines thereof in cyclic fashion rhythm signals in the rhythm pattern selected within the enabled section of said memory means, and counter means clocked by said rhythm clock pulses for producing a cyclically repeating series of counts supplied to the address lines of said memory means to enable selected said address lines on respective counts.

10. The rhythm generator of claim 9 wherein said counts produced by said counter are multiple bit binary words having least significant bits and most significant bits.

11. The rhythm generator of claim 10 wherein said control means control the logic level of the respective bits of said binary words having the greatest significance to thereby determine which of said memory sections are enabled.

12. The rhythm generator of claim 9 including means for selectively deleting certain ones of said counts per cycle of said counter means.

13. The rhythm generator of claim 12 wherein said means for selectively deleting comprises means for decoding the counts produced by said counter and partially resetting said counter means after a selected number of counts.

14. The rhythm generator of claim 13 wherein the counts which are deleted is determined by the patterns selected by said pattern select means.

15. The rhythm generator of claim 9 wherein said memory means, said control means and said counter means are contained within a single integrated circuit chip, and said control means includes a trinary decoder having a single external chip pin.

* * * * *

UNITED STATES PATENT AND TRADEMARK OFFICE

CERTIFICATE OF CORRECTION

PATENT NO. : 4,186,639

DATED : February 5, 1980

INVENTOR(S) : John W. Robinson and Ralph N. Dietrich

It is certified that error appears in the above-identified patent and that said Letters Patent are hereby corrected as shown below:

Column 4, line 56, change "along" to --alone--
Column 6, line 37, change "lease" to --least--
Column 6, line 45, insert --due-- after "105"
Column 8, line 2, change "in" to --a--
Column 8, line 3, change "in" to --on--

Claim 1, column 9, line 6, insert --instrument-- after "musical"
Claim 6, column 9, line 65, change "counter" (second occurrence) to --control--
Claim 11, column 10, line 46, change "control" second occurrence, to -- controls --.

Signed and Sealed this

*Twenty-seventh* Day of *May 1980*

[SEAL]

*Attest:*

SIDNEY A. DIAMOND

*Attesting Officer*

*Commissioner of Patents and Trademark*